US006176218B1

(12) United States Patent
Beechie et al.

(10) Patent No.: US 6,176,218 B1
(45) Date of Patent: Jan. 23, 2001

(54) STABILIZING FUNCTION FOR TORQUE BASED IDLE CONTROL

(75) Inventors: Brian E. Beechie, Farmington Hills; Gregory L. Ohl, Ann Arbor; Michael J. Prucka, Lake Orion; James W. Yip, Pinckney, all of MI (US)

(73) Assignee: DaimlerChrysler Corporation, Auburn Hills, MI (US)

( * ) Notice: Under 35 U.S.C. 154(b), the term of this patent shall be extended for 0 days.

(21) Appl. No.: 09/401,751

(22) Filed: Sep. 23, 1999

(51) Int. Cl.[7] ..... F02D 41/16
(52) U.S. Cl. ..... 123/339.19; 123/339.22
(58) Field of Search ..... 123/339.14, 339.19, 123/339.22, 339.23, 339.24, 585; 701/102, 110

(56) References Cited

U.S. PATENT DOCUMENTS

| | | | |
|---|---|---|---|
| 5,168,449 | 12/1992 | Benford | 701/51 |
| 5,235,946 | 8/1993 | Fodale et al. | 477/109 |
| 5,377,112 | 12/1994 | Brown, Jr. et al. | 701/115 |
| 5,508,923 | 4/1996 | Ibamoto et al. | 701/70 |
| 5,511,412 | 4/1996 | Campbell et al. | 73/117.3 |
| 5,517,964 | 5/1996 | Chen et al. | 123/339.11 |
| 5,720,258 | 2/1998 | Tolkacz et al. | 123/352 |

*Primary Examiner*—Tony M. Argenbright
(74) *Attorney, Agent, or Firm*—Mark P. Calcaterra

(57) ABSTRACT

A method for stabilizing the idle of an engine for a motor vehicle includes determining an engine rotational speed, modifying the engine rotational speed to define a friction engine speed, estimating a mechanical friction loss as a function of the friction engine speed, defining a torque request as a function of the mechanical friction loss and utilizing the torque request to control the engine at idle.

15 Claims, 2 Drawing Sheets

STABILIZING FUNCTION FOR TORQUE BASED IDLE CONTROL

BACKGROUND OF THE INVENTION

1. Technical Field

The present invention generally pertains to an engine control system for governing the idle of an internal combustion engine. More particularly, but without restriction to the particular embodiment and/or use which is shown and described for purposes of illustration, the present invention relates to a stabilizing system used in conjunction with a torque based idle control system.

2. Discussion

The motor vehicle is an increasingly complicated, dynamically changing machine. In order to maximize performance and increase component durability, it is desirable to have the capability of controlling an engine to produce a specific engine flywheel torque. To accomplish this task, an accurate estimate of the engine's internal frictional loss must be calculated. In a torque based idle control system, the engine friction characterization is one of the primary requesters of torque. Because the engine friction estimate is a function of engine rotational speed and intake manifold pressure, small fluctuations in either component may cause similar fluctuations in the frictional loss estimate. Accordingly, an unstable idle may result due to the fluctuating, "noisy", estimate of the torque required to overcome friction.

During idle conditions, the driver's flywheel torque request is theoretically constant. Therefore, the desired torque during unloaded idle is equal to the friction torque estimate plus an idle control torque. The idle control torque is the additional torque required to idle the engine as determined by the idle speed control module. Instabilities can occur at idle because both the friction torque estimate and the idle control torque request vary with changes in engine speed and intake manifold pressure. De-coupling the friction torque estimate and the idle control torque requests at idle will allow for better idle control, especially in small displacement engines, resulting in greater customer satisfaction.

SUMMARY OF THE INVENTION

It is therefore an object of the present invention to provide a stabilizing function for a torque based idle control system.

It is another object of the present invention to provide a system using actual engine speed during normal driving conditions and a target idle speed when the engine is unloaded at idle.

It is yet another object of the present invention to provide a smooth transition when switching between the torque based idle control algorithms and the non-idle control systems.

The present invention relates to a method for stabilizing the idle of an engine for a motor vehicle. The method includes measuring an engine rotational speed, modifying the engine rotational speed to define a friction engine speed, estimating a mechanical friction loss as a function of the friction engine speed, defining a torque request as a function of the mechanical friction loss and utilizing the torque request to control the engine at idle.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENTS

Figure 1:
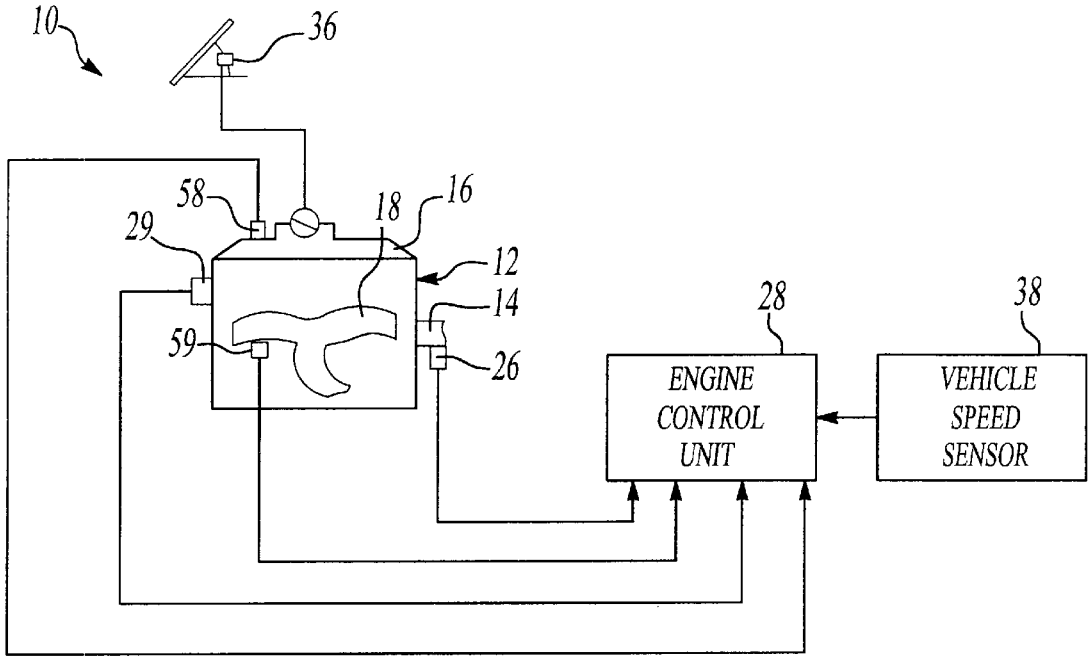
FIG. 1 is a schematic diagram of an exemplary motor vehicle engine control system including a stabilizing system for torque based control according to the principles of the present invention.

With initial reference to FIG. 1, a motor vehicle engine control system constructed in accordance with the teachings of an embodiment of the present invention is generally identified at reference numeral 10. The motor vehicle engine control system 10 includes an engine 12 having an output shaft 14 for supplying power to driveline components and driven wheels (not shown). The engine 12 includes an intake manifold 16 for channeling atmospheric air to the engine's combustion chambers and an exhaust manifold 18 providing a path for the exhaust gasses to escape.

Figure 2:
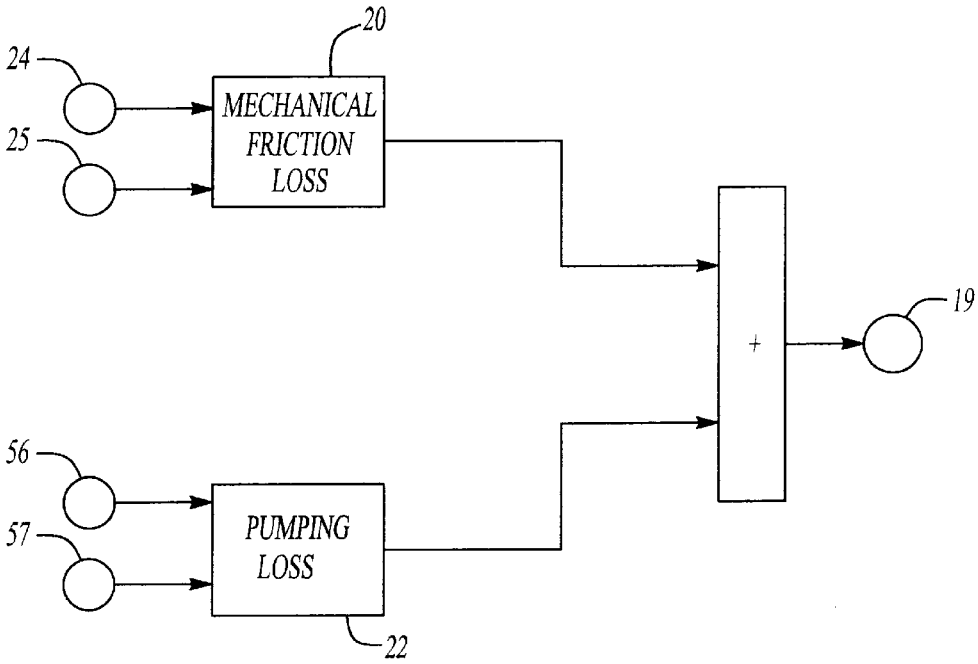
FIG. 2 is a flow diagram representative of the computer program instructions executed by the friction characterization system of the present invention.

The engine 12 operates, like any other machine, at an efficiency less than one hundred percent. As shown in FIG. 2, a total frictional loss 19 can be divided into two major components. The first type of loss, a mechanical frictional loss 20, is generated from a variety of sources including piston to cylinder wall friction, bearing friction, water pump friction and any other interface of moving components. The second type of loss is generally referred to as a pumping loss 22. The pumping loss 22 is a result of pumping air from a low pressure side at the intake manifold 16 to a high pressure side at the exhaust manifold 18.

The mechanical friction loss 20 is a function of many factors including an engine rotational speed 24, a coolant temperature 25, an elapsed time since start and component tolerances. As shown in FIG. 1, a rotational speed sensor 26 is operatively associated with the engine 12 to provide the engine rotational speed 24 to an engine control unit 28. One skilled in the art will appreciate that the rotational speed sensor 26 may include a variety of devices capable of determining engine rotational speed. Specifically, an encoder (not shown) outputs electrical pulses every certain number of degrees of rotation of the output shaft 14. The encoder may be used in combination with a timer to determine engine rotational speed 24. One skilled in the art will further appreciate that other methods and mechanisms for determining the engine rotational speed 24 may be implemented without departing from the scope of the present invention. Similarly, a coolant temperature sensor 29 provides the coolant temperature 25 to the engine control unit 28. The engine control unit 28 manipulates the data obtained from the various engine sensors to estimate the amount of mechanical frictional loss at any given time. As earlier mentioned, this method of internal frictional loss estimation is very effective at operating speeds greater than idle speed. However, because both the friction estimate and the idle torque request are based on the engine rotational speed 24, an instability occurs if the real time rotational speed data is used as a feedback control at idle speeds.

Figure 3:
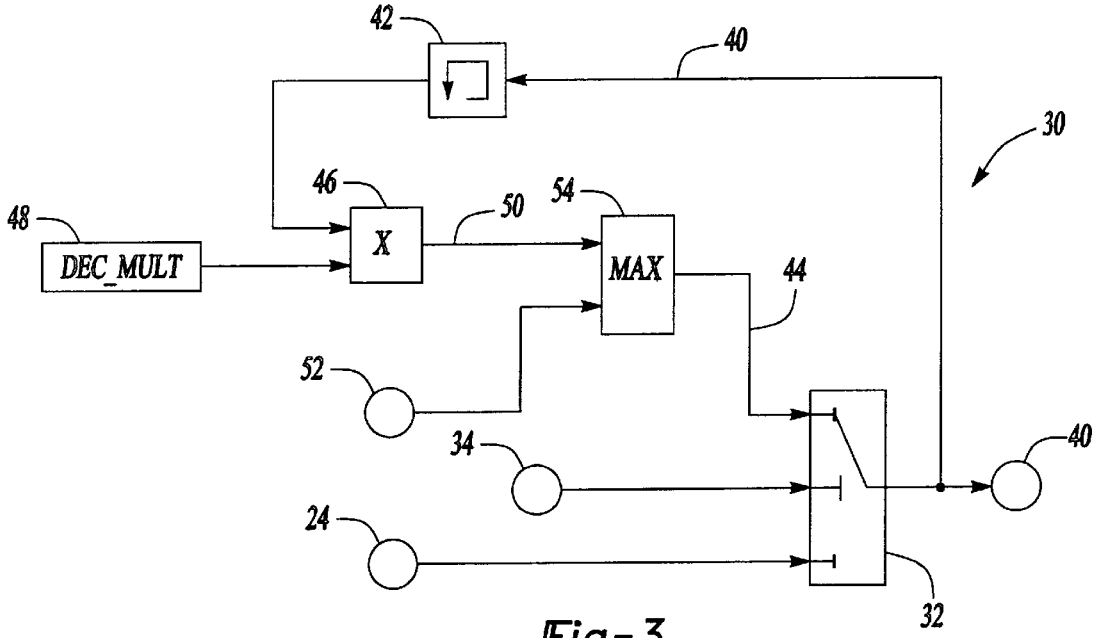
FIG. 3 is a flow diagram representative of the computer program instructions executed by the engine speed stabilizing system of the present invention.

Referring to FIG. 3, an engine speed stabilizing system 30 of the present invention is schematically represented. Specifically, the state of a logic gate 32 is defined by first determining if the engine 12 is operating at idle. An idle module 34 collects data from a variety of vehicle sensors to determine if the engine 12 is at idle. As shown in FIG. 1, an accelerator pedal position sensor 36, a vehicle speed sensor 38, and the engine rotational speed sensor 26 must each output signals indicating that the vehicle 10 is at rest operating without a load on the engine 12 in order to positively answer the question that idle conditions have been met. One skilled in the art will appreciate that the stabilizing system 30 of the present invention is operable in a vehicle utilizing a mechanical throttle control system or an electronic throttle control system as shown in FIG. 1.

If idle conditions are not met, the idle module 34 outputs a negative signal to the logic gate 32. Accordingly, the logic gate 32 enters a passive state to accept the engine rotational speed 24 as an input. Therefore, a friction engine speed 40 will be equal to the real time engine rotational speed 24. On the contrary, if idle conditions have been met, the idle module 34 outputs a positive signal to the logic gate 32 forcing the logic gate 32 to enter an active state as shown in FIG. 3.

The engine speed stabilizing system 30 includes a storage device 42 that captures the most recent output of the friction engine speed 40. One skilled in the art will appreciate that the engine control unit 28 collects data from each of the afore-mentioned sensors at a relatively high frequency. Accordingly, the engine speed stabilizing system 30 may utilize the data at an equal or lower rate than the engine control unit 28. Preferably, the engine speed stabilizing system 30 collects data at the same rate as the engine control unit 28.

The purpose of the engine speed stabilizing system 30 is to provide a smooth signal to the engine control unit 28 when the engine 12 is operating at an idle condition. To provide a smooth transition from the real time engine rotational speed input 24 to a stabilized idle speed 44, the most recent friction engine speed 40 is modified in block 46 of FIG. 3. Specifically, a decrement constant 48 is multiplied by the friction engine speed 40 in block 46. A decrement friction engine speed is output at 50. The decrement friction engine speed 50 is then compared to a target idle speed 52 initially set when the engine 12 is started. A filter 54 passes the larger of the target idle speed 52 and the decrement friction engine speed 50 on to the logic gate 32.

One skilled in the art will appreciate that the filter 54 effectively places a lower limit on the friction engine speed 40 equal to the target idle speed 52. Accordingly, a stable, smoothly transitioned frictional engine speed 40 results. More specifically, by implementing the engine speed stabilizing system 30, the torque based idle control system is not forced to chase an oscillating estimate of the total energy loss 19 due to variations in the mechanical friction loss 20. Referring to FIG. 2, one skilled in the art will appreciate that implementation of the engine speed stabilizing system 30 is accomplished by inputting the friction engine speed 40 at the location where the real time engine rotational speed 24 was previously input.

The pumping loss estimate 22 is a function of an intake manifold pressure 56 and an exhaust manifold pressure 57. As shown in FIG. 1, an intake manifold pressure sensor 58 is operatively associated with the engine 12 to provide data regarding the intake manifold pressure 56 to the engine control unit 28. Similarly, an exhaust pressure sensor 59 collects the exhaust manifold pressure 57 data. In an alternative embodiment, the engine control unit 28 manipulates the data obtained from the intake manifold pressure sensor 58 to estimate the amount of pumping loss present. One skilled in the art will appreciate that the present invention is applicable to either method of determining the pumping loss 22 because the intake manifold pressure 56 is used in both cases. As mentioned earlier, these methods of pumping loss estimation are very effective at operating speeds greater than idle speed. However, because the pumping loss estimate is a function of the intake manifold pressure 56, the total energy loss 19 will vary as the intake manifold pressure 56 varies.

Figure 4:
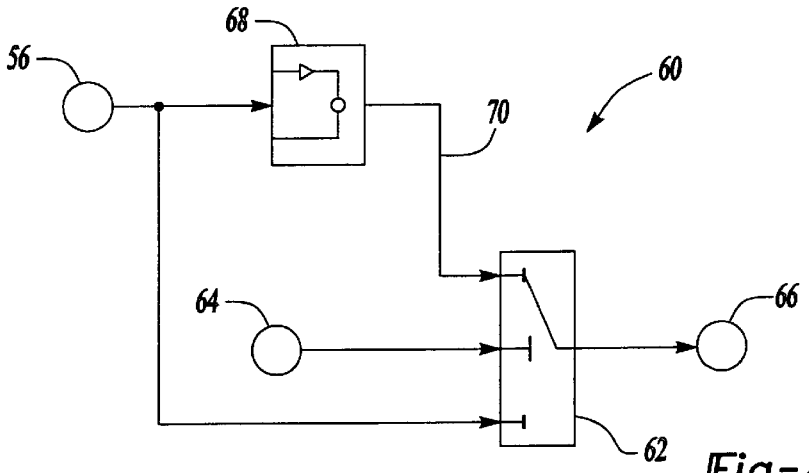
FIG. 4 is a flow diagram representative of the computer program instructions executed by the manifold pressure stabilizing system of the present invention.

Referring to FIG. 4, a manifold pressure stabilizing system is depicted at reference numeral 60. The manifold pressure stabilizing system 60 includes a logic gate 62 for accepting an input 64 to determine if idle conditions have been met. As previously defined, idle conditions exist when each of the accelerator position sensor 36, the vehicle speed sensor 38, and the engine rotational speed sensor 26 each output a signal indicating that the vehicle 10 is at rest and operating without a load. If idle conditions have not been met, the logic gate 62 is in a passive state and directly accepts the intake manifold pressure 56. Accordingly, a friction manifold pressure 66 will be equal to the real-time intake manifold pressure 56.

If the engine 12 is found to be at an idle, the logic gate 62 is in an active state and remains in the condition as depicted in FIG. 4. In order to calculate the friction manifold pressure 66 when the engine 12 is operating at an idle condition, the intake manifold pressure 56 is supplied to a first order manifold pressure filter 68. A filtered manifold pressure 70 is defined by the following function:

$$P_{FIL}=C\ P+(1-C)(P_{FILPREV})$$

where $P_{FIL}$=filtered manifold pressure,

C=constant,

P=manifold pressure, and $P_{FILPREV}$=previous filtered manifold pressure.

The manifold pressure filter 68 utilizes a previous filter manifold pressure equal to the barometric pressure of the atmosphere the first time the calculation is performed. Subsequently, the most recently calculated filtered manifold pressure 70 is used during subsequent loops of the program. The filtered manifold pressure 70 next passes through the logic gate 62 to become the friction manifold pressure 66. One skilled in the art will appreciate that the first order manifold pressure filter 68 has the effect of smoothing a fluctuating input signal such as the intake manifold pressure 56. Accordingly, and in reference to FIG. 2, the friction manifold pressure 66 is input where the real time intake manifold pressure 56 was input prior to implementation of the manifold pressure stabilizing system 60.

Objects of the invention may now be realized once the friction engine speed 40 and the friction manifold pressure 66 are computed. Specifically, a stable idle will result because the friction torque estimate made by the engine control unit 28 will be based on the friction engine speed 40 and the friction manifold pressure 66 of the present invention.

Figure 5:
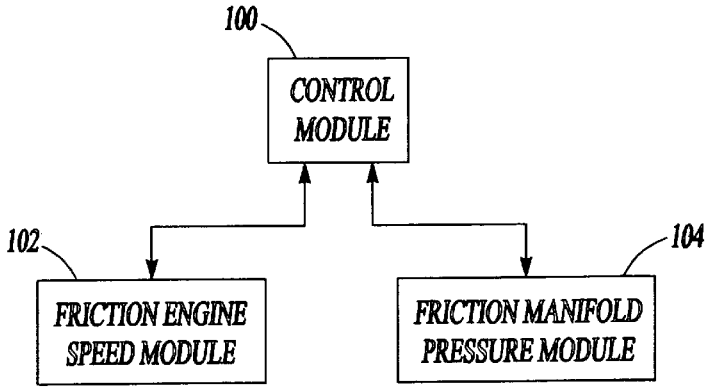
FIG. 5 is a logic diagram showing a graphical representation of the stabilizing system of the present invention.

In addition, one skilled in the art will appreciate that the afore-mentioned logical steps may be performed by individual modules in communication with each other as shown in FIG. 5. Specifically, a control module 100 is in communication with a friction engine speed module 102, where the friction engine speed 40 is calculated, and a friction manifold pressure module 104 where the friction manifold pressure 66 is calculated.

It is intended that the invention not be limited to the particular embodiment illustrated by the drawings and described in the specification as the best mode presently contemplated for carrying out this invention, but that the invention will include any embodiment falling within the description of the appended claims.

What is claimed:

1. A method for stabilizing the idle of an engine for a motor vehicle, the method comprising the steps of:

determining an engine rotational speed;

modifying said engine rotational speed to define a friction engine speed;

estimating a mechanical friction loss as a function of said friction engine speed;

defining a torque request as a function of said mechanical friction loss; and utilizing said torque request to control the engine at idle.

2. The method for stabilizing the idle of an engine of claim 1, wherein the step of modifying said engine rotational speed to define a friction engine speed includes multiplying a previous friction engine speed by a constant.

3. The method for stabilizing the idle of an engine of claim 2, wherein the constant has a magnitude between zero and one.

4. The method for stabilizing the idle of an engine of claim 2, wherein the step of modifying said engine rotational speed to define a friction engine speed has a lower limit set equal to a target idle speed.

5. The method for stabilizing the idle of an engine of claim 1, further including the step of estimating a pumping loss as a function of an intake manifold pressure wherein the step of defining a torque request as a function of the mechanical friction loss further includes defining the torque request as a function of said pumping loss.

6. The method for stabilizing the idle of an engine of claim 5, wherein the step of estimating the pumping loss includes modifying said intake manifold pressure by passing a signal through a filter.

7. The method for stabilizing the idle of an engine of claim 6, wherein said filter is a first order filter.

8. A method for stabilizing the idle of an engine for a motor vehicle, the method comprising the steps of:

determining a friction engine speed of the engine;

determining a decrement engine friction speed by multiplying said friction engine speed by a constant;

determining a stabilized idle speed by choosing the greater of said decrement engine friction speed and a target idle speed; and utilizing a new friction engine speed equal to said stabilized idle speed to control the engine at idle.

9. The method for stabilizing the idle of an engine of claim 8, wherein said step of determining a friction engine speed includes determining a rotational speed of the engine.

10. The method for stabilizing the idle of an engine of claim 8, further including the step of determining a friction manifold pressure of the engine.

11. The method for stabilizing the idle of an engine of claim 10, wherein said step of determining a friction manifold pressure includes filtering an intake manifold pressure.

12. A stabilizing system for the engine a motor vehicle comprising:

a control module;

a friction engine speed module for determining a friction engine speed term, said friction engine speed module in communication with said control module; and a friction manifold pressure module for determining a friction manifold pressure term, said friction manifold pressure module in communication with said control module; said control module determining a mechanical friction loss as a function of said friction engine speed term and a pumping loss as a function of said friction manifold pressure term for directing a vehicle control system.

13. The stabilizing system of claim 12, wherein said friction engine speed module includes a storage device for retaining a previous friction engine speed term, said friction engine speed term incrementally reduced to approach a target idle speed.

14. The stabilizing system of claim 12, wherein said friction manifold pressure module includes a filter for reducing the variation in said friction manifold pressure term.

15. The stabilizing system of claim 12, wherein said friction manifold pressure module includes a logic gate that switches between an active state and a passive state, said logic gate in said active state when the engine is operating at an idle.

* * * * *